United States Patent [19]

Kime

[11] 4,371,318

[45] Feb. 1, 1983

[54] HYDRAULIC FLUID POWER SYSTEM

[76] Inventor: James A. Kime, 3360 Parkway Center, Columbus, Ohio 43026

[21] Appl. No.: 150,563

[22] Filed: May 16, 1980

Related U.S. Application Data

[63] Continuation-in-part of Ser. No. 952,299, Oct. 18, 1978, abandoned.

[51] Int. Cl.[3] ..... F04R 49/02

[52] U.S. Cl. ..... 417/304; 417/308; 417/309; 60/464

[58] Field of Search ..... 417/304, 306, 308, 309; 60/464

[56] References Cited

U.S. PATENT DOCUMENTS

| | | | |
|---|---|---|---|
| 1,509,051 | 9/1924 | McBryde | 417/306 |
| 2,572,263 | 10/1951 | Hofer | 417/306 |
| 3,903,698 | 9/1975 | Gellatly et al. | 60/464 X |
| 4,097,200 | 6/1978 | Baits | 417/306 X |

*Primary Examiner*—Richard E. Gluck

*Attorney, Agent, or Firm*—James F. Porcello, Jr.

[57] ABSTRACT

A hydraulic fluid power system incorporating a supplemental pressurization system at the intake side of a hydraulic pump. The supplemental pressurization system includes a supplementary reservoir in communication with a primary fluid accumulator and an intake conduit of the hydraulic pump. The reservoir supplements hydraulic fluid flow to the intake side of the pump whenever intake line pressure drops below one atmosphere. Should the combined hydraulic fluid flow from the accumulator and the reservoir be insufficient to raise the intake pressure to prevent cavitation of the pump, an air ingestion valve opens to supply air to the intake side of the pump until proper pressurization is achieved, whereby the supplemental pressurization system closes off.

5 Claims, 4 Drawing Figures

HYDRAULIC FLUID POWER SYSTEM

BACKGROUND OF THE INVENTION

This application is a continuation-in-part of my earlier filed co-pending application, Ser. No. 952,299, filed Oct. 18, 1978, now abandoned.

The invention relates to hydraulic fluid power systems and more specifically to a high pressure hydraulic system incorporating a closed cycle having a hydraulic fluid accumulator, a hydraulic pump and a supplemental pressurization means which is composed of a supplemental reservoir and an air ingestion valve working in combination to minimize cavitation problems associated with the pumping of the hydraulic fluid.

High pressure hydraulic systems have gained wide acceptance as a means of transferring energy in manufacturing operations, on-site at construction projects and wherever an activity requires or benefits from power assisted equipment. Hydraulic power is especially suitable for outdoor work.

One source of hydraulic energy is a land vehicle which has been equipped with a hydraulic pump driven by the internal combustion engine of the vehicle. Often times these hydraulic pumps and the associated components are installed in unused space in the engine compartment of the vehicle by the purchaser and user rather than by the manufacturer of the vehicle. Conventional hydraulic fluid practice dictates that the components associated with the hydraulic pump, especially the fluid reservoir, be located as close as possible to the pump in order to minimize cavitation problems brought about by a long intake line and its attendant large pressure drop. Frequently, however, insufficient space in the engine compartment of the vehicle is available for the installation of the components other than the pump and they must be installed at a location remote from the engine compartment. The physical separation of the pump and reservoir, which may be as great as 20 feet or more, deleteriously effects the operation of the hydraulic system. The lower pressure at the intake of the hydraulic pump, due partially to the pressure drop associated with the long intake line, which is especially severe during start up of the hydraulic system, causes cavitation of the hydraulic fluid which may damage or destroy the hydraulic pump.

In the prior art, the problem of fluid cavitation and pump damage was partially solved by limiting the separation of the fluid reservoir from the pump, thus minimizing the length of the intake line. When the placement of components was dictated by the space in the engine compartment left unoccupied by the vehicle manufacturer, a subsequent installer of a hydraulic system was faced with insurmountable installation problems.

Yet another prior art solution to the problem of fluid cavitation and pump damage resulted in increasing the size of the intake line, intake port and other fluid-laden components to allow for increased fluid flow with less resistance. It can be appreciated that the diameter of the intake lines as well as the length of the intake lines affect the pressure of the pump intake.

SUMMARY OF THE INVENTION

The non-cavitating hydraulic fluid system of the instant invention comprises a hydraulic fluid accumulator, a hydraulic pump, a forced air hydraulic fluid cooler, a filter, a hydraulically powered tool and means for driving the hydraulic pump. A novel supplemental pressurization system is in communication with the intake side of the pump and the hydraulic fluid accumulator to prevent cavitation at the pump intake.

The operation of the non-cavitating hydraulic system is most apparent during start-up. When the pump is not in operation, the pressure of the system will commonly be 0 p.s.i. gauge or a pressure of one atmosphere on an absolute scale. As the pump begins to rotate, the pressure of the hydraulic fluid at the intake of the pump will begin to decrease. In a conventional pump an intake pressure will soon be reached at which the hydraulic fluid will cavitate within the pump. Continued operation at this condition may cause damage to or destroy the pump. A pump according to the instant invention incorporates a supplemental pressurization system at the intake of the pump. As the pressure in the intake conduit drops below atmospheric pressure, a check valve opens, pulling supplemental hydraulic fluid from a supplemental reservoir to flow to the intake side of the pump. As the pump continues to operate, the pressure in the hydraulic system, including the intake conduit increases and soon is equal to the pressure of the atmosphere whereupon the check valve closes and no additional supplemental fluid enters the hydraulic system.

The supplemental reservoir is required primarily for fluid make-up. Since the main working oil does not pass through this vessel, its volume capacity is generally 1/10 or 1/20 the volume capacity of [reservoirs] incorporated in the present state of the art. Conduits going to and from the supplemental reservoir are significantly smaller than conduits used in present circuits. It is essential that the supplemental intake conduit connect to the intake conduit at the closest possible proximity to the pump intake in order to take advantage of the lowest existing pressure in the intake conduit.

The working fluid is filtered and cooled in every cycle and since the working fluid is only that which is present in the conduits or components, a complete fluid cycle takes place in a matter of seconds. In winter operation this affords rapid warmup of the hydraulic fluid enabling the system to achieve optimum performance in a greatly reduced period of time.

Should the hydraulic fluid flow from the supplemental reservoir be insufficient to increase the pressure in the intake conduit to atmospheric, an air valve opens which ingests air into the hydraulic fluid at the intake conduit. The ingested air is homogenized with the hydraulic fluid and pumped through the system. As the pump continues to operate the pressure in the hydraulic system will increase and will soon be equal to atmospheric pressure whereupon the air valve closes and no additional air enters the hydraulic system. The homogenized hydraulic fluid travels through the circuit and enters the accumulator wherein the air escapes from the hydraulic fluid. The accumulator is constructed to allow the air entrained in the hydraulic fluid to escape and collect in the upper portion of the accumulator. The air which gathers in the upper portion of the accumulator thus forms a compressible pneumatic cushion which helps stabilize the operation of the system and facilitates subsequent start-ups. If accumulator air pressure exceeds a preselected level, it escapes from the accumulator through a capillary tube of small cross-section to the supplemental reservoir which is fitted with an atmospheric breather.

Because of the compressible pneumatic cushion, the hydraulic pressure in a system according to the instant invention will not decay as rapidly or to such a low level as will a conventional system during the same period of time. Therefore, if a system according to the instant invention is quiescent for a period of time and subsequently restarted, it may be under several pounds of pressure. Such a pressurized condition will eliminate cavitation and damage to the pump at start-up. Furthermore, if the pressure in the hydraulic system is sufficiently low that the pressure at the pump intake does momentarily drop below atmospheric pressure at start-up, the check valve will open and ingest supplemental oil into the system thereby eliminating cavitation and pump damage as well as adding additional fluid to the hydraulic system. This extra fluid will gather in the accumulator and pass to the supplemental reservoir through the bleeder conduit. Thus, the amount of extra fluid added to the hydraulic system and which accumulates in the accumulator will be self-limiting.

It can be appreciated by one skilled in the art that the benefits of the supplemental pressurization system can also be applied to portable hydraulic fluid power systems. The supplemental pressurization system allows greater flexibility in selecting component size.

Desired levels of power can be achieved when small pumps run at greater than currently accepted speeds. The supplemental pressurization system also creates rapid warmup and cooling of the hydraulic fluid power system and works to maintain the working life of the hydraulic fluid of longer period of operation.

Thus it is the object of this invention to provide a hydraulic fluid system which is free of the deleterious effects of cavitation.

It is a further object of the instant invention to provide a hydraulic fluid system in which the pump is not subject to the deleterious effects of the cavitation and which exhibits improved, constant pressure delivery at the intake port of the pump.

It is a still further object of the instant invention to provide a hydraulic fluid system wherein the hydraulic pump may be separated from the other components of the hydraulic system by a substantial distance.

DESCRIPTION OF THE PREFERRED EMBODIMENT

Figure 1:
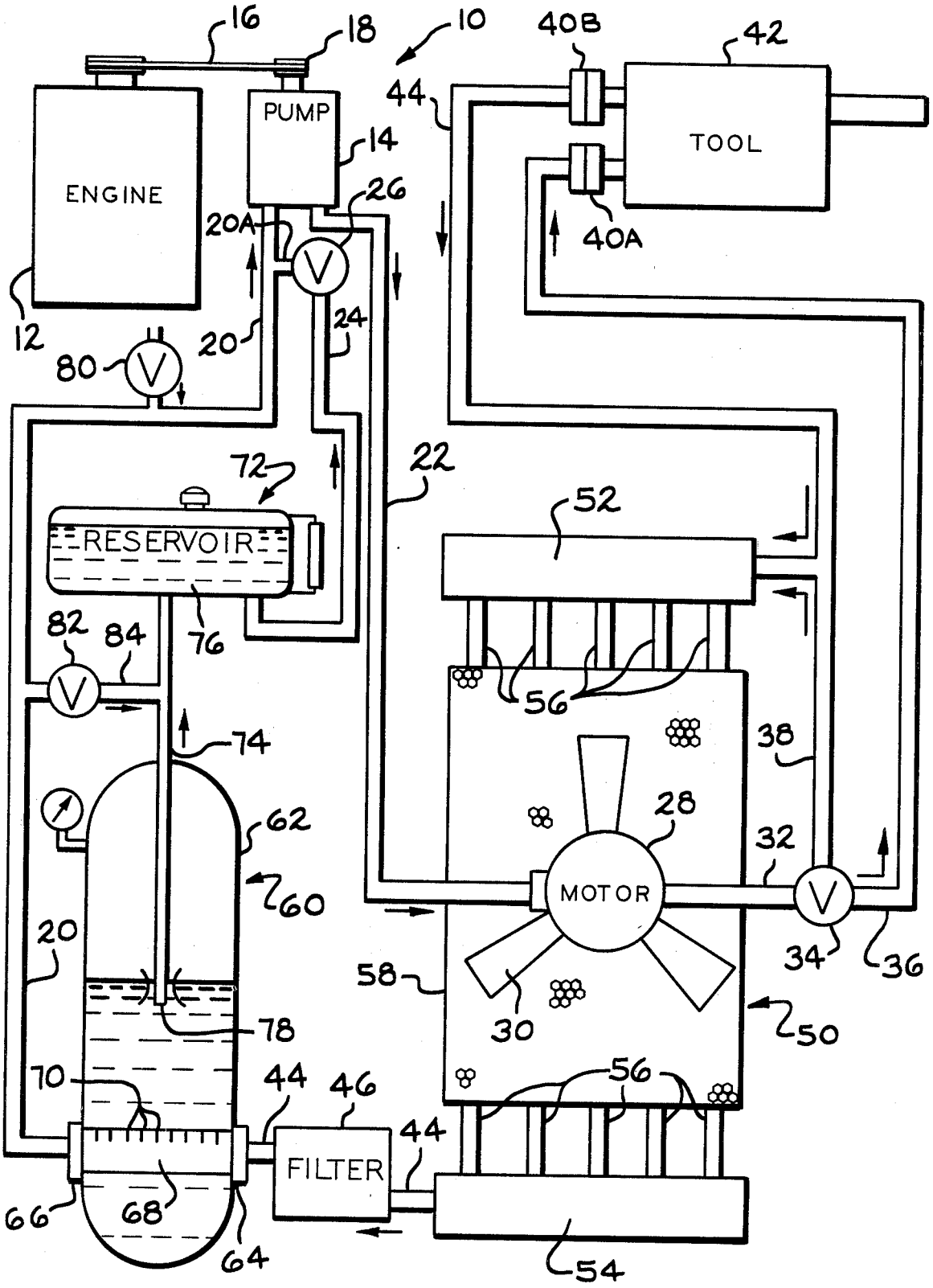
FIG. 1 is a diagrammatic view of a hydraulic fluid system incorporating the improvements in the instant invention.

Referring now to FIG. 1, a hydraulic fluid power system incorporating the instant invention is generally designated by the reference numeral 10. The hydraulic fluid power system 10 includes a source of power such as an internal combustion engine 12. The internal combustion engine 12 drives a hydraulic pump 14 through an energy transfer device such as a belt 16. The hydraulic pump 14 may be a gear type pump or other conventional design well known in the art. The hydraulic pump 14 preferably includes a selectively engageable clutch 18. The clutch 18 is preferably an electro-magnetic type which selectively engages or disengages the pump 14 from the engine 12 and the drive belt 16 in a manner well known in the art. The hydraulic pump 14 further includes an inlet or intake line 20 and a pressurized outlet or delivery line 22.

The delivery line 22 supplies hydraulic fluid under high pressure to the other components of the hydraulic fluid power system 10. The delivery line 22 supplies pressurized hydraulic fluid to a hydraulic gear motor 28. The hydraulic gear motor 28 is preferably of conventional design and inasmuch as such a motor would be well known to one skilled in the art of the hydraulics, it will not be described in further detail. The hydraulic motor 28 supplies rotary power to an integrally mounted fan 30 which is utilized to provide forced air flow over a hydraulic fluid heat exchanger assembly 50. The embodiments of the heat exchanger assembly 50 will be described subsequently. The outlet of the hydraulic gear motor 28 is connected by means of a hydraulic line 32 to a pressure relief valve 34. The pressure relief valve 34 defines two outlets in communication with two hydraulic lines 36 and 38. The pressure relief valve 34 monitors the pressure of the hydraulic fluid in the lines 32 and 36 and under normal conditions of operation connects hydraulic line 32 to hydraulic line 36 and passes hydraulic fluid therebetween. As the pressure in the hydraulic lines 32 and 36 increase, due generally to excessive loading or resistance, the pressure relief valve 34 will direct an appropriate quantity of hydraulic fluid along the hydraulic bypass line 38 such that the pressure in the hydraulic lines 32 and 36 is maintained at a predetermined maximum pressure.

The hydraulic line 36 is preferably terminated by a quick-connect hydraulic connector assembly 40A. The connector assembly 40A both passes hydraulic fluid to a hydraulically powered tool 42 and permits both disconnection and reconnection of another hydraulic tool in a manner well known in the art. The hydraulic tool 42 may, of course, be one of a number of hydraulically powered tools such as an impact wrench, a chain saw, a soil tamper or a grinder. A second quick-connect hydraulic connector 40B interconnects the hydraulic fluid output of the tool 42 with a return line 44. It is to be understood that the quick-connect hydraulic connectors 40A and 40B both incorporate flow restricting check valves which seal off the hydraulic lines 36 and 44, respectively, upon disconnection of the tool 42 therefrom and thus prevent release of hydraulic fluid during this procedure. The hydraulic fluid return line 44 is connected to the hydraulic bypass line 38 and a hydraulic fluid heat exchanger assembly 50. The heat exchanger assembly 50 comprises an inlet header 52 connected to the return line 44 which communicates with an outlet header 54 through a plurality of thin-walled heat conductive tubes 56. The heat exchanger tubes 56 are encased in a heat exchanger grid 58 having a high surface area to volume ratio. Hydraulic fluid flowing in the bypass line 38 or the return line 44 passes through the inlet head 52, through the heat exchanger tubes 56 whereupon heat is removed through the grid 58 to the atmosphere. As previously described, the hydraulic gear motor 28 and fan 30 provide forced air flow over the heat exchanger grid 58, thereby increasing the heat transfer.

The outlet header 54 is connected by return line 44 to the fluid filter assembly 46. A fluid filter assembly 46 is a device which traps particulate matter which is circulating within the hydraulic fluid. Such filters are well known to a person skilled in the art of hydraulics and it will not therefore be further described.

From the outlet of the filter assembly 46, the hydraulic return line 44 is connected to a hydraulic fluid accumulator assembly 60 by the hydraulic fluid return line 44. The fluid accumulator assembly 60 comprises a closed tank 62 having an inlet fitting 64 and an outlet fitting 66 located adjacent the bottom of the tank 62 and interconnected by a generally horizontal and radially disposed tube 68 having a plurality of transverse slots 70 disposed on its upper surface and providing communication between the interior and the exterior of the tube 68. The outlet fitting 66 of the tank 62 is connected to the hydraulic intake line 20 which returns hydraulic fluid to the pump 14.

A supplemental pressurization assembly 72 is in communication with the fluid accumulator assembly 60 and the intake line 20. A capillary tube 74 of a thin cross-section connects the supplemental reservoir 76 with the interior of the closed tank 62. Excess air or hydraulic fluid accumulating in the closed tank 62 will escape through the capillary tube 74 to the supplemental reservoir 76. Because the mouth 78 of the capillary tube 74 is of small cross-section, excess air escapes rapidly whereas excess hydraulic fluid moves very slowly due to the relatively high viscosity of the hydraulic fluid.

The supplemental reservoir 76 is connected to the intake line 20 by supplemental intake line 24. Check valve 26, for example, a ball valve located within the supplemental intake line 24, is sensitive to atmospheric pressure. When the pressure in intake line 20 is above atmospheric pressure, check valve 26 remains closed. Should the pressure in intake line 20 drop below that of atmospheric, the check valve 26 will open, injecting extra hydraulic fluid from supplemental reservoir 76 through check valve 26 into the intake line 20. When the intake pressure rises above atmospheric, check valve 26 will close, thereby cutting off the extra flow of hydraulic fluid. In order to achieve the most rapid response to a pressure drop in intake line 20 which would cause cavitation in the pump 14, the supplemental intake line 24 and check valve 26 must be connected to intake line 20 as close as possible to the intake port of the pump 14.

An air valve 80 is connected to inlet line 20 between the accumulator assembly 60 and the pump 14. Should the pump 14 have a severe pressure drop at intake which cannot be remedied with excess fluid from the supplemental reservoir 76, air valve 80 will open thereby ingesting air into inlet line 20. The ingested air will mix with the hydraulic fluid and cycle the hydraulic circuit to the accumulator 60 where it collects. Such a collection of air in the accumulator 60 will increase the pressure within the accumulator 60, thereby pressurizing intake line 20. Air valve 80 is commonly referenced to open when the intake vacuum exceeds a selected value in a range of 2–7 psi. When the intake pressure relieves the excess vacuum, the air valve 80 will close, thereby eliminating the ingestion of air.

A reference pressure relief valve 82 is provided which connects the inlet line 20 with a conduit 84 leading to supplemental reservoir 76. Because the shaft seals of the pump 14 are limited in design to the maximum internal pressure, reference valve 82 will open at 22 psi thereby returning excess fluid to supplemental reservoir 76.

Referring now to FIG. 1, the operation of the hydraulic fluid power system 10 incorporating the instant invention will be described. For the purposes of the initial portion of this description, it will be assumed that the hydraulic tool 42 is connected across the hydraulic lines 36 and 44 and that the system is not pressurized, i.e., the pressure of the system is 0 psi, gauge, or one atmosphere on an absolute pressure scale. With the internal combustion engine 12 operating, the clutch 18 is engaged and the hydraulic pump 14 begins to rotate. Hydraulic fluid is then drawn from the intake line 20 and the hydraulic fluid accumulator assembly 60 and pumped into the hydraulic delivery line 22 under pressure. As noted previously, frictional losses in the suction line 20 may cause the pressure on the intake side of the hydraulic pump 14 to drop substantially below atmospheric pressure. In a conventional pump, cavitation may occur under these low pressure conditions. If allowed to continue, operation under such conditions may damage or destroy the pump mechanism.

A pump, such as the hydraulic pump 14 incorporating the instant invention minimizes cavitation and eliminates the possibility of damage caused thereby. When the pressure in the intake line 20 and the passageway 20A drops below atmospheric, the check valve 26 opens, forcing extra hydraulic fluid to enter the supplemental intake line 24, thereby ingesting extra fluid into intake line 20. As the pump 14 continues to operate, hydraulic fluid flows around the closed circuit defined by the hydraulic system 10 and the pressure therein rises thereby eliminating cavitation.

Once hydraulic fluid flow has been established, the motor 28 and fan 30 will operate and force air over the grid 58 of the heat exchanger assembly 50 and assist the removal of heat from the hydraulic fluid passing through the tubes 56 of the heat exchanger assembly 50.

Should the combined fluid flow from the accumulator assembly 60 and the supplemental reservoir 76 be insufficient to overcome the intake vacuum, air valve 80 will open, ingesting air into the intake line 20. Air ingested through the air valve 80 will flow with the hydraulic fluid about the hydraulic circuit until it reaches accumulator assembly 60. As the air-laden hydraulic fluid passes through the tube 68 within the tank 62, the air rises through the transverse slots 70 and collects in the upper region of the tank 62, thereby pressurizing the accumulator 60. The collected air forms a pneumatic cushion which not only smooths the pulsations of the hydraulic pump 14 but also provides residual hydraulic pressure.

As the pressure in the hydraulic system 10 continues to rise, the pressure in the intake line 20 and the passageway 20A will soon equal and exceed the pressure of the atmosphere at which time the check valve 26 will close terminating the ingestion of excess fluid into the system. If it was necessary for the air valve 80 to also open to avoid cavitation, then the increased pressure in intake line 20 will also close air valve 80, terminating the ingestion of air into the system. The excess fluid and air which accumulates in the tank 62 will bleed through capillary tube 74 into the supplemental reservoir 76.

As the hydraulic fluid and aerated fluid gather in the accumulator 60 the mouth 78 of the bleed line 74 will be found under the top surface of the aerated fluid which floats to the surface of the accumulated hydraulic fluid. Because the capillary tube 74 is of such small cross-section, the excess aerated fluid will escape slowly. Therefore, the accumulator 60 pressure will degenerate at a slow pace. The pneumatic cushion will remain to assist in preventing potential future cavitation.

When the hydraulic fluid power system 10 is shut down by deactivating the clutch assembly 18 or stopping the internal combustion engine 12, the pressure within the system will not drop immediately to the pressure of one atmosphere of the absolute scale as is common with most hydraulic systems. Rather, the air cushion within the fluid accumulator assembly 60 and the supplemental reservoir assembly 72 will maintain a slowly decaying pressure within the entire system. When the system is restarted, if the pressure within the hydraulic system 10 has dropped to that of atmospheric on an absolute scale, the startup sequence will be like that just delineated. However, most commonly, the pressure within the system 10 will not have completely decayed. It should be apparent that inasmuch as cavitation within the hydraulic pump 14 is primarily the result of low intake pressure, such a startup mode eliminates the tendency toward cavitation.

An alternate embodiment of the accumulator assembly 60 includes a referenced check valve (not shown) within the radially and horizontally disposed tube 68 which will remain closed until pressure within the accumulator tank 62 exceeds the reference check valve pressure, usually 2–20 psi. This reference check valve will assist in more rapid pressurization of the hydraulic system. Of course, as the reference check valve is closed, no hydraulic fluid is flowing from the accumulator assembly 60, therefore the supplemental pressurization system 72 will be in full operation to make up the missing flow from the accumulator assembly 60.

Figure 2:
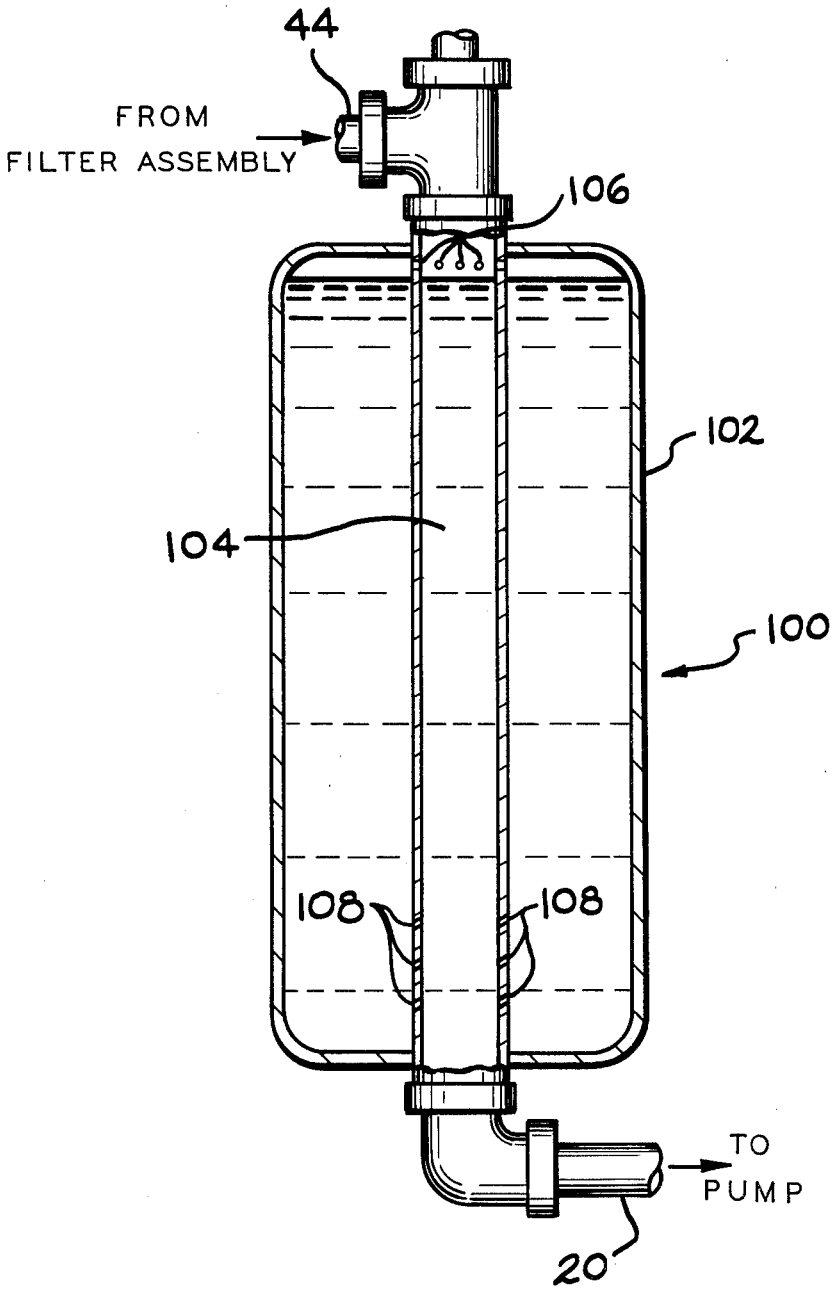
FIG. 2 is an alternate embodiment of a hydraulic fluid accumulator of the instant invention.

Referring now to FIG. 2, an alternate embodiment of the fluid accumulator assembly 100 is illustrated. The alternate embodiment assembly 100 comprises a vertically disposed generally cylindrical tank 102. Disposed concentrically and vertically within the tank 102 is a pipe 104 which moves hydraulic fluid from the filter assembly 46, through the cylindrical tank 102 and out to the intake line 20 and hydraulic pump 14. The pipe 104 includes a plurality of upper ports 106 within the tank 102 and adjacent its upper end which provide communication between the interior of the pipe 104 and the interior of the tank 102. The pipe 104 further defines a plurality of lower ports 108 within the tank 102 adjacent its lower end which provide communication between the interior of the pipe 104 and the interior of the tank 102. The alternate embodiment fluid accumulator assembly 100 may also include a pressure gauge (not shown) which is connected into the return line 44 carrying hydraulic fluid from the filter assembly 46. The operation of the alternate embodiment fluid accumulator assembly 100 is analogous to the operation of the preferred embodiment fluid accumulator assembly 60. Air entrained in the hydraulic fluid entering the pipe 104 within the cylindrical tank 102 will pass through the plurality of upper ports 106 and accumulate in the upper region of the tank 102. The pneumatic cushion thus provided minimizes start-up cavitation and functions in a manner in all respects identical to that of the preferred embodiment of the fluid accumulator assembly 60 previously described. If additional hydraulic fluid is needed in the remainder of the system 10, the lower ports 108 allow hydraulic fluid to flow from the fluid accumulator assembly 100 into the system 10 to replace fluid which may have been lost through leaks in the system.

Figure 3:
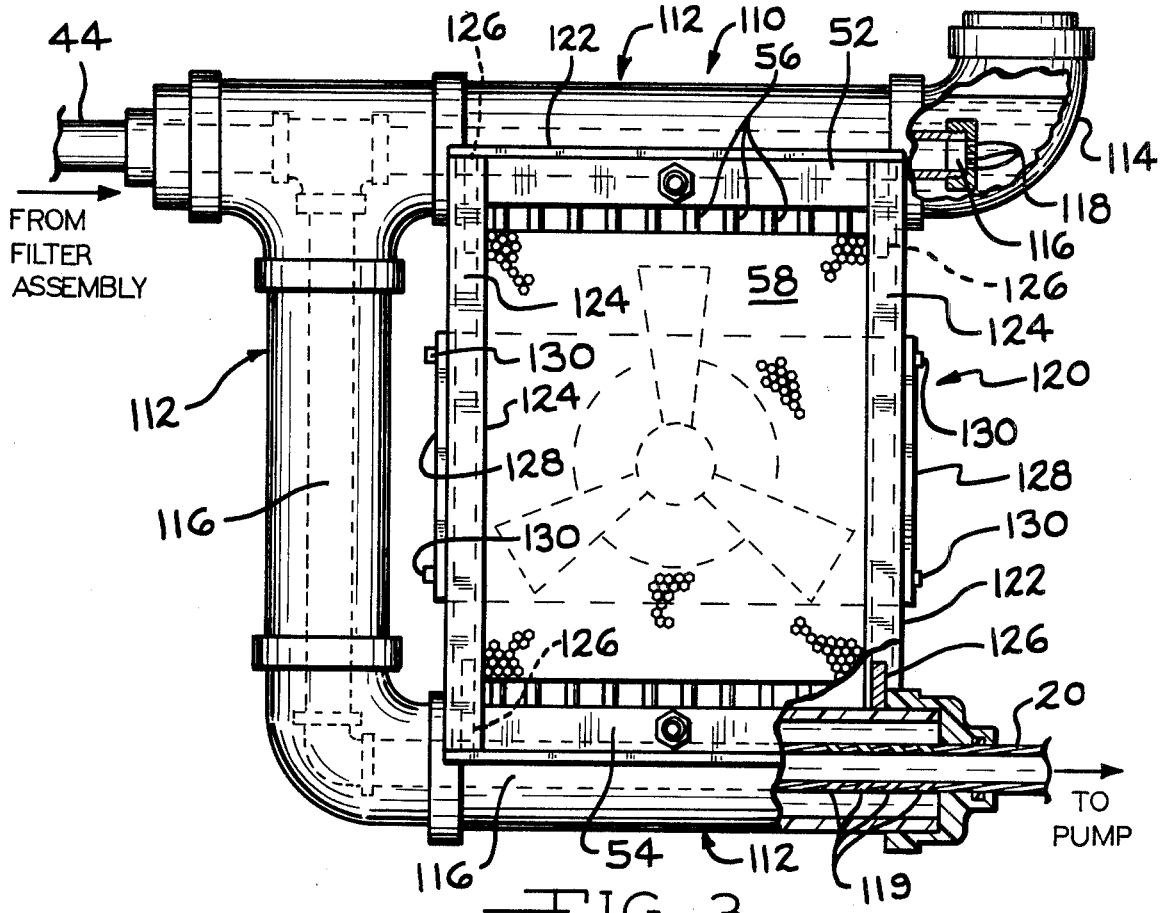
FIG. 3 is a front elevational view of a combination hydraulic fluid accumulator and heat exchange assembly according to the instant invention.
Figure 4:
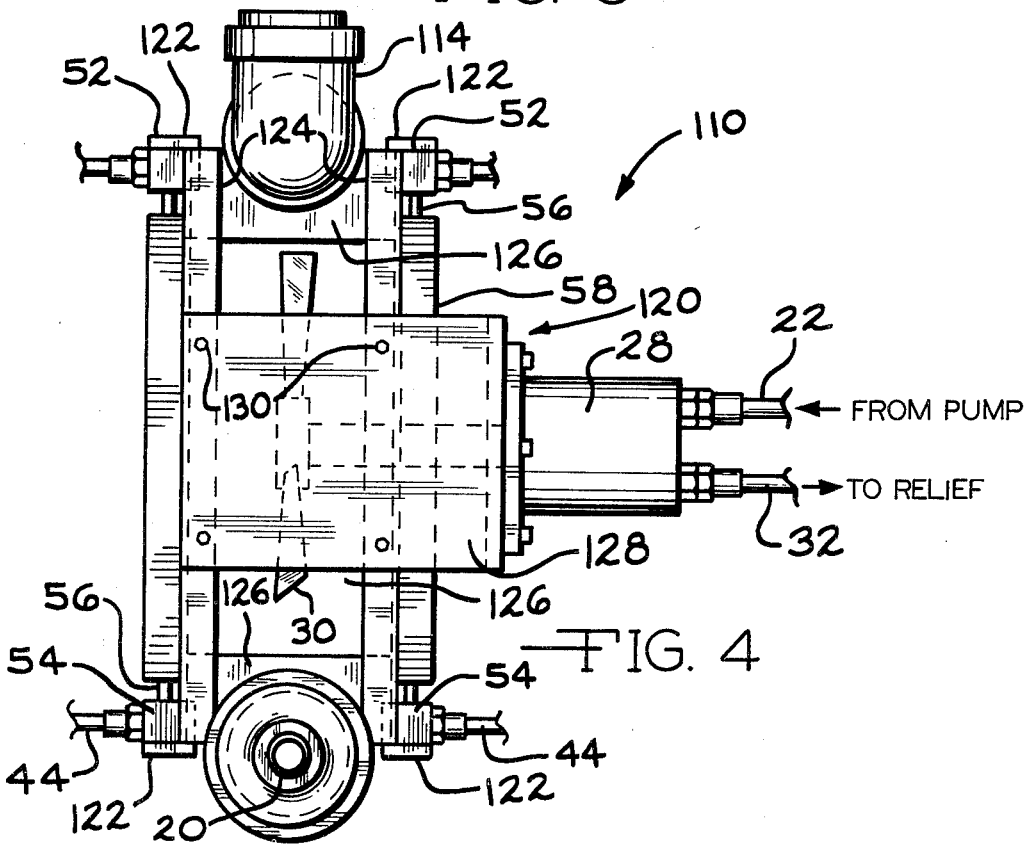
FIG. 4 is a side elevational view of a combination hydraulic fluid accumulator and heat exchange assembly according to the instant invention.

Referring now to FIGS. 3 and 4, a combined heat exchanger assembly and fluid accumulator assembly designated by the reference numeral 110 is illustrated. In certain installation, space will be very limited and the combined heat exchanger and accumulator assembly 110 will be preferable to the embodiments previously described. The combined assembly 110 comprises a generally horizontally disposed, U-shaped fluid accumulator 112 within which a heat exchanger assembly 120 is secured. The fluid accumulator assembly 112 comprises a sealed, U-shaped tank 114 which may be fabricated from conventional plumbing components. Disposed within and coaxial to the U-shaped tank 114 is U-shaped pipe 116 which provides a flow path through the fluid accumulator assembly 112 from the return line 44 to the suction line 20. A plurality of upper ports 118 provide communication between the interior of the pipe 116 and the interior of the U-shaped tank 114. The upper ports 118 are structurally and functionally analogous to the upper ports 106 described in connection with the alternate embodiment hydraulic fluid accumulator assembly 100. The U-shaped pipe 116 further includes a plurality of lower ports 119 disposed along its lower horizontal portion. The lower ports 119 are structurally and functionally analogous to the lower ports 108 previously described in connection with the alternate embodiment hydraulic fluid accumulator assembly 100.

Positioned and secured between the parallel arms of the U-shaped tank 114 is the heat exchanger assembly 120. The heat exchanger assembly 120 includes the components previously described in connection with the preferred embodiment, namely the hydraulic gear motor 28, the fan 30 connected thereto but it also includes a dual heat exchanger structure comprising a pair of the inlet headers 52 connected respectively to a pair of the outlet headers 54 by means of a plurality of tubes 56 which are enclosed in a pair of the grids 58. Each of the headers 52 and 54 is secured to a right angle bracket 122 which extends beyond the ends of the headers 52 and 54 and is secured thereto by welding, brazing or other suitable means. The ends of the horizontal brackets 122 are each secured to a vertically disposed channel bracket 124 which is also secured to rectangular brackets 126 having an arcuate cutout complementary to the outer cross-sectional radius of the U-shaped tank 114. The heat exchanger assembly 120 further includes a saddle bracket 128 which defines two parallel end plates which are secured to the vertically disposed channel brackets 124 by a plurality of fasteners 130 and a side plate which spans the horizontal distance between the channel brackets 124 and to which the hydraulic gear motor 28 is secured. The right angle brackets 122, the channel brackets 124, the rectangular brackets 126 and saddle bracket 128 in conjunction with the headers 52 and 54 and the interconnecting tubes 56 thus form a rigid assembly which may be positioned between the parallel arms of the U-shaped tank 114 and secured thereto. The supplemental pressurization assembly 72 utilized and described in the preferred embodiment of the hydraulic fluid power system 10 may be utilized with the alternate embodiment combination air and hydraulic fluid reservoir and heat exchanger assembly 110.

Operation of the hydraulic fluid power system 10 incorporating either the alternate embodiment hydraulic fluid accumulator 100 or the alternate embodiment combination hydraulic fluid accumulator and heat exchanger assembly 110 is the same as that previously described in connection with the preferred embodiment illustrated in FIG. 1.

The foregoing disclosure is the best mode devised by the inventor for practicing this invention. It is apparent, however, that devices incorporating modifications and variations to the instant invention will be obvious to one skilled in the art of hydraulics. Inasmuch as the foregoing disclosure is intended to enable one skilled in the pertinent art to practice the instant invention, it should not be construed to be limited thereby. Rather, the invention should be construed to include such aforementioned obvious variations and be limited only the spirit and scope of the following claims.

What I claim is:

1. A hydraulic system comprising a hydraulic pump, a hydraulic fluid intake conduit in communication with said pump, a hydraulic fluid discharge conduit in communication with said pump, an accumulator containing hydraulic fluid in communication with said intake conduit, supplemental pressurization means in communication with said intake conduit, said supplemental pressurization means including a supplemental reservoir containing reserve hydraulic fluid in communication with said accumulator and said intake conduit, a valve positioned between said supplemental reservoir and said intake conduit wherein said valve opens when the pressure in said intake conduit is below a reference pressure, drawing reserve hydraulic fluid from said supplemental reservoir through said valve into said intake conduit, and said valve closes when the pressure in said intake conduit is above the reference pressure, wherein said supplemental pressurization means further includes a second valve means for ingesting air into said intake conduit, and load connectors in communication with said conduits for receiving hydraulic loading devices, wherein said supplemental pressurization means becomes functional when the pressure in said intake conduit is below a reference pressure and ceases to function when the pressure inside said intake conduit is above a reference pressure.

2. A hydraulic system as defined in claim 1 wherein said second valve means is open when the pressure in said intake conduit is below a second reference pressure and is closed when the pressure in said intake conduit is above said second reference pressure.

3. A hydraulic system comprising a hydraulic pump, a hydraulic fluid intake conduit in communication with said pump, a hydraulic discharge fluid conduit in communication with said pump, an accumulator containing hydraulic fluid in communication with said intake conduit, supplemental pressurization means in communication with said intake conduit, wherein said supplemental pressurization means includes a supplemental reservoir containing reserve hydraulic fluid in communication with said accumulator and said intake conduit, a first valve means between said supplemental reservoir and said intake conduit, said first valve means opening when the pressure of said intake conduit is below a reference and closing when the pressure of said intake conduit achieves one atmosphere or greater, and a second valve means for ingesting air into said intake conduit, said second valve means opening when the pressure of said intake conduit severely drops and such combination of hydraulic fluid and reserve hydraulic fluid from said accumulator and said supplemental reservoir cannot raise the pressure of said intake conduit above the reference pressure.

4. A hydraulic system as defined in claim 3 wherein said accumulator includes a reference valve, said reference valve being normally closed, blocking hydraulic fluid flow from said intake conduit into said accumulator and from said accumulator to said intake conduit, said reference valve being open when the pressure within said intake conduit is greater than the pressure reference of said reference valve.

5. A hydraulic system comprising a hydraulic pump, a hydraulic fluid intake conduit in communication with said pump, a hydraulic fluid discharge conduit in communication with said pump, an accumulator containing hydraulic fluid in communication with said intake conduit, a supplemental pressurization means in communication with said intake conduit, said supplemental pressurization means comprising a supplemental reservoir containing reserve hydraulic fluid in communication with said accumulator and said intake conduit, a check valve between said supplemental reservoir and said intake conduit, said check valve opening when the pressure of said intake conduit is below one atmosphere and closing when the pressure of said intake conduit achieves one atmosphere or greater, a valve means for ingesting air into said intake conduit, said valve means opening when the pressure of said intake conduit drops and such combination of hydraulic fluid and reserve hydraulic fluid from said accumulator and said supplemental reservoir cannot raise the pressure of said intake conduit above one atmosphere, and a reference check valve, said reference valve being normally closed and said reference valve being open when the pressure within said intake conduit is greater than the pressure reference of said reference valve.

* * * * *